US010712012B2

(12) United States Patent
Alvarado

(10) Patent No.: US 10,712,012 B2
(45) Date of Patent: Jul. 14, 2020

(54) BURNER AND MODULAR HEAT USING APPLIANCES THEREFORE

(71) Applicant: Jesus Alvarado, Van Nuys, CA (US)

(72) Inventor: Jesus Alvarado, Van Nuys, CA (US)

(73) Assignee: Jesus M. Alvarado, Van Nuys, CA (US)

( * ) Notice: Subject to any disclaimer, the term of this patent is extended or adjusted under 35 U.S.C. 154(b) by 172 days.

(21) Appl. No.: 15/932,952

(22) Filed: May 30, 2018

(65) Prior Publication Data

US 2019/0368741 A1 Dec. 5, 2019

(51) Int. Cl.

| | |
|---|---|
| ***F24B 5/02*** | (2006.01) |
| ***F24B 1/02*** | (2006.01) |
| ***F24B 13/04*** | (2006.01) |
| ***F24B 13/02*** | (2006.01) |
| *F24B 13/00* | (2006.01) |

(52) U.S. Cl.

CPC ..... *F24B 5/025* (2013.01); *F24B 1/028* (2013.01); *F24B 5/021* (2013.01); *F24B 5/026* (2013.01); *F24B 5/028* (2013.01); *F24B 13/02* (2013.01); *F24B 13/04* (2013.01); *F24B 13/008* (2013.01)

(58) Field of Classification Search

CPC ..... F24B 13/002; F24B 5/02; F24B 5/023; F24B 5/025; F24B 5/026; F24B 1/028; F24B 13/04; A47J 36/2477; A47J 36/26

See application file for complete search history.

(56) References Cited

U.S. PATENT DOCUMENTS

| | | | | |
|---|---|---|---|---|
| 54,705 | A * | 5/1866 | Fair | F24B 5/02 126/58 |
| 2,190,139 | A * | 2/1940 | Stockell | F24B 1/202 126/25 R |
| 4,471,751 | A * | 9/1984 | Hottenroth | F24C 1/16 126/15 R |
| 5,622,161 | A * | 4/1997 | Stack | F24B 5/026 126/77 |
| 9,677,724 | B2 * | 6/2017 | McClean | F21L 26/00 |
| 2010/0083946 | A1 * | 4/2010 | Cedar | H01L 35/30 126/5 B |
| 2012/0060819 | A1 * | 3/2012 | Hunt | A47J 36/2477 126/1 R |

OTHER PUBLICATIONS

Josh Dahlke; Gear Review: Camp Chef Stryker Portable Backpacking Stove; accessed Feb. 26, 2020; published Dec. 18, 2015; https://www.outdoorlife.com/blogs/cast-iron-chef/gear-review-camp-chef-stryker-portable-backpacking-stove/. (Year: 2015).*

(Continued)

*Primary Examiner* — Daniel J Colilla

(57) ABSTRACT

A fuel burner and optional modular heat utilizing appliances capable of exploiting heat from the fuel burner are shown and described. The burner includes a fire box including a fuel holder, a surrounding inner housing, and an outer shroud surrounding the inner housing. A plurality of air openings including flow adjusters admit air to the fire box. The inner housing and outer shroud are configured to supply air for secondary combustion of the exhaust. The burner may include a fan for forced air induction, and a fuel chute having a slidable closure for recharging the fuel holder from outside. At least one modular heat utilizing appliance may have thermal insulation for retaining heat.

10 Claims, 1 Drawing Sheet

(56) References Cited

OTHER PUBLICATIONS 1-2 People Camping Boiler Bowl Set Portable Cookware; Amazon.com product website; accessed Feb. 24, 2020; published Aug. 18, 2014 ; https://www.amazon.ca/people-camping-Camping-Cookware-Alcohol/dp/B00MTIVFUU/ref=sr_1_1?dchild=1&keywords=1-2+people+camping+boiler&qid=1582731339&sr=8-1. (Year: 2014).*

* cited by examiner

BURNER AND MODULAR HEAT USING APPLIANCES THEREFORE

FIELD OF THE INVENTION

The present invention relates to fuel burners for serving heat using appliances.

BACKGROUND OF THE INVENTION

This application improves upon the burner shown in application Ser. No. 15/186,527, now U.S. Pat. No.

SUMMARY OF THE INVENTION

The present invention modifies my prior burner by improving combustion air delivery, enabling additional fuel to be supplied without disturbing appliances using heat output by the burner, and optionally adding insulation to modular appliances usable with the burner for retaining heat.

The burner includes a fire box including a fuel holder, a surrounding inner housing, and an outer shroud surrounding the inner housing. A plurality of air openings including flow adjusters admit air to the fire box. The inner housing and outer shroud are configured to supply air for secondary combustion of the exhaust. The burner may include a fan for forced air induction, and a fuel chute having a slidable closure for recharging the fuel holder from outside. At least one modular heat utilizing appliance may have thermal insulation for retaining heat.

Air delivery is improved by optionally providing a fan propelling forced air, and optionally adding manually controlled combustion air inlets. An optional fuel chute is located to avoid interference with appliances using heat output by the burner.

The present invention provides improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
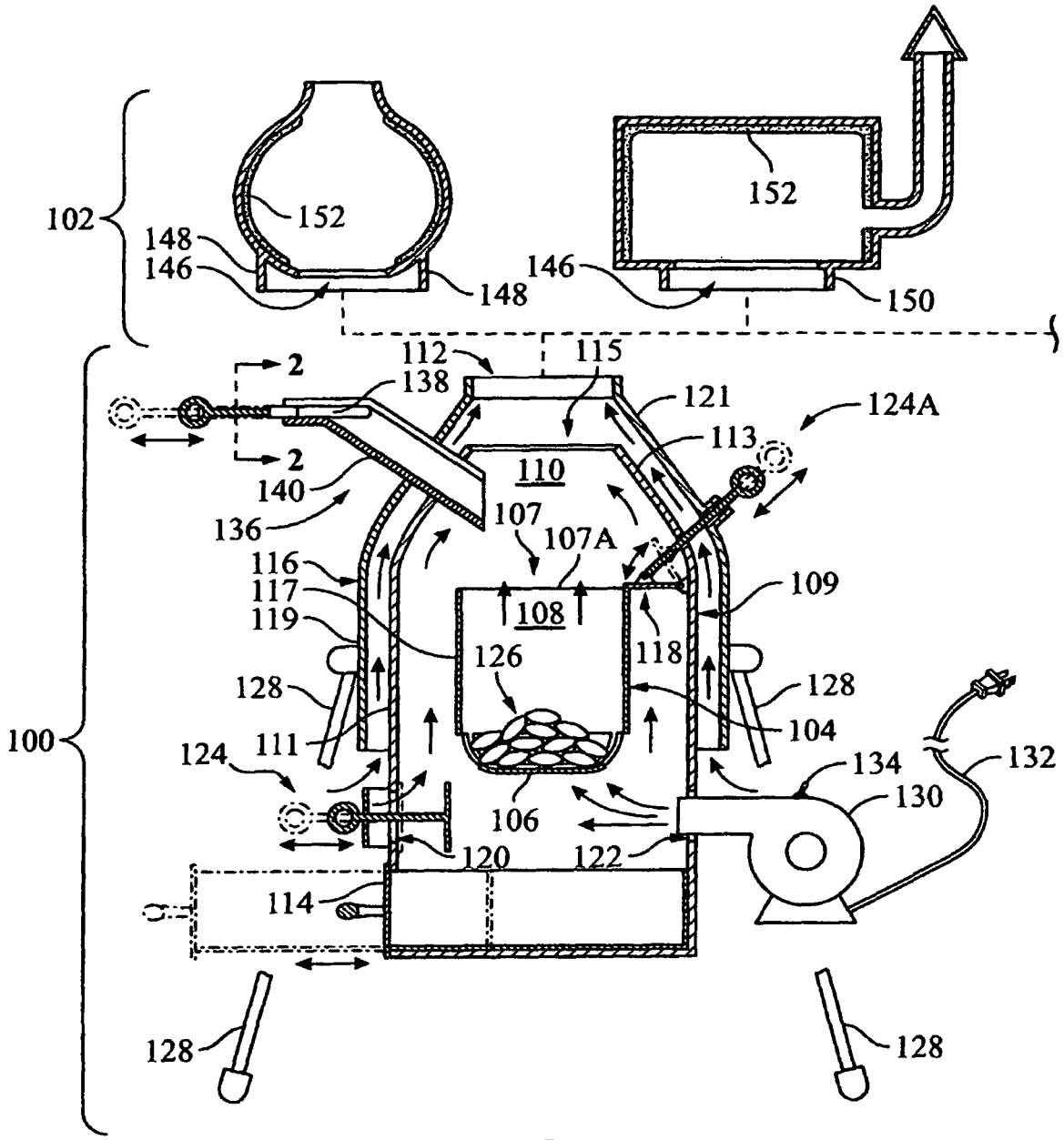
FIG. 1 is a side elevational view of the novel burner and two of a number of substitutable modular appliances usable with the burner.

Referring first to FIG. 1, according to at least one aspect of the invention, there is shown a burner 100 for a heat utilizing appliance 102. Burner 100 comprises a fire box 104 and a fuel holder 106 within fire box 104. Fire box 104 comprises a lateral wall 108 surrounding and spaced apart from fuel holder 106. Fire box 104 comprises a top opening 107 including an open top end 107A.

Burner 100 comprises an inner housing 109 spaced apart from and surrounding the fire box 104. Inner housing 109 comprises a lateral wall 111, a tapered top wall 113, and a first exhaust outlet 115.

Burner 100 comprises an outer shroud 116 surrounding and spaced apart from an upper portion 117 of fire box 104 of burner 100. Outer shroud 116 comprises a second lateral wall 119 and a second exhaust outlet 112. Outer shroud 116 is configured to constrain air immediately outside fire box 104 to flow by convection radially inwardly to join exhaust products flowing upwardly from second exhaust outlet 112, thereby interposing a thermally insulating barrier between lateral wall 108 of fire box 104 and an exterior of burner 100.

An ash pan 114 is coupled to burner 100 below fuel holder 104 so that ash pan 114 is movable between a closed position closing a bottom of fire box 104 of burner 100 and an open position enabling removal of ashes (not shown) from ash pan 114.

Burner 100 comprises at least one air opening 120 in inner housing 109 admitting air to assist combustion. At least one air opening (e.g., air opening 120) includes a flow adjuster 124 adjustable to selectively vary flow of air through the air opening including flow adjuster 124.

A first lateral wall 111 and first top wall 113 of inner housing 109, and a second lateral wall 119 and a second top wall 121 of outer shroud 116 are collectively configured to guide inducted air flowing around fuel holder 104 inwardly from a periphery of fire box 104 to join exhaust products flowing upwardly through second exhaust outlet 112 when solid fuel 126 is being burned in fuel holder 104, thereby supporting secondary combustion above fuel holder 104. First top wall 113 and second top wall 121 may be inclined and parallel, as shown in FIG. 1.

It should be noted at this point that orientational terms such as above, upper, upwardly, and bottom refer to the subject drawing as viewed by an observer. The drawing figures depict their subject matter in orientations of normal use, which could obviously change with changes in posture and position of burner 100 and heat utilizing appliances 102. Therefore, orientational terms must be understood to provide semantic basis for purposes of description, and do not limit the invention or its component parts in any particular way.

Unless otherwise indicated, the terms "first", "second", etc., are used herein merely as labels, and are not intended to impose ordinal, positional, or hierarchical requirements on the items to which these terms refer. Moreover, reference to, e.g., a "second" item does not either require or preclude the existence of, e.g., a "first" or lower-numbered item, and/or, e.g., a "third" or higher-numbered item.

Two types of heat utilizing appliances 102 are shown in FIG. 1. However, additional types may be provided, as set forth in U.S. Pat. No. Heat utilizing appliances 102 utilize heat of combustion from burner 100, wherein fire box 104 and fuel holder 106 collectively define a combustion chamber. Heated exhaust gases escape through second exhaust outlet 112, and impinge upon a selected heat utilizing appliance 102 placed on top end 107A. Top end 107A may include a grate (not shown) if desired.

As seen in FIG. 1, ash pan 114 slides laterally to open for access to ashes (not shown). The closed position of ash pan 114 is shown in solid lines in FIG. 1. The open position is shown in broken lines.

As utilized herein, "radially inwardly" refers to directions approaching a vertical center line of the combustion chamber.

It will be appreciated that assistance to combustion provided by air openings 118, 120, 122 may refer to primary combustion occurring in the combustion chamber, or alternatively, to secondary combustion above the combustion chamber. Therefore, the various air openings 118, 120, and 122 may be utilized selectively in various combinations, and at various capacities, depending upon adjustments.

Flow adjuster 124 may comprise a poppet valve or alternatively, may use pivotal action or lateral sliding action. The former is illustrated at flow adjuster 124 at the lower left of FIG. 1. Pivotal action is illustrated at flow adjuster 124A at the upper right of FIG. 1.

Burner 100 may comprise a plurality of legs 128 coupled to burner 100, legs 128 spacing burner 100 above the ground. This is an option, as in some uses, it may be tolerable to place burner 100 on the ground. Alternatively, in some uses, burner 100 may be suspended from above or supported from the side, so that legs 128 may not be required.

Optionally, the at least one air opening includes at least one first air opening 120 below fire box 104 and fuel holder 106. Air admitted by air opening 120 may serve both primary and secondary combustion. Optionally, the plurality of air openings may include at least one second air opening 118 above fire box 104 and fuel holder 106. Air admitted by air opening 118 will support secondary combustion. The plurality of air openings may optionally include at least one third air opening 122 having a powered fan 130 arranged to force air induction to fuel holder 106. Powered fan 130 may be DC and connected to a battery (not shown), or may be AC and connected to a standard residential or commercial 120V electric circuit via a plug and cord assembly 132. Fan 130 may be controlled by a controller 134. Controller 134 may comprise a simple on-off switch, or may have current or voltage variation to vary fan speeds.

Figure 2:
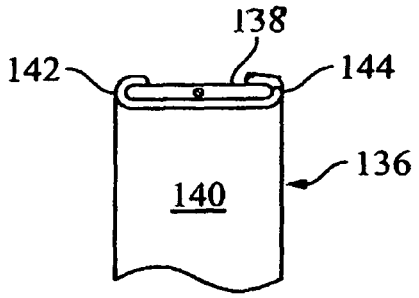
FIG. 2 is an end detail view of a fuel chute seen toward the upper left of FIG. 1.

Referring to both FIGS. 1 and 2, burner 100 may further comprise a fuel chute 136 coupled to burner 100 and arranged to communicate between an interior of fire box 104 and ambient air outside burner 100. Fuel chute 136 is accessible for receiving and conducting solid fuel 126 into fire box 104 without requiring moving of a heat utilizing appliance 102 sitting on (or over) second exhaust outlet 112.

Fuel chute 136 may include a slidable closure slidable between an open position (shown in solid lines) providing access to fire box 104 for charging the burner with solid fuel and a closed position (shown in broken lines) preventing products of combustion from escaping burner 100 through fuel chute 136. Fuel chute 136 may engage slidable closure 138 with sufficient friction to oppose spontaneous opening of slidable closure 138 under ordinary conditions of use. As seen in FIG. 2, slidable closure 138 engages a bottom wall 140 and partially surrounding short walls 142, 144. Fit within bottom wall 140 and short walls 142, 144 allows slidable closure 138 to slide, but requires manual effort to open and close.

Slidable closure 138 is one form of a flow adjuster adjustable to selectively vary flow of air through the one air opening including the flow adjuster. Where controller 134 provides voltage or current variation, controller 134 is regarded as another type of flow adjuster.

The invention may be regarded as a combination of burner 100 (as described above) and modular heat utilizing appliance 102. At least one modular heat utilizing appliance 102 may have a lower surface 146 dimensioned and configured to rest on second top wall 121 of outer shroud 116 above second exhaust outlet 112. Modular heat utilizing appliances can exploit heat in the exhaust products flowing upwardly through second exhaust outlet 112.

Modular heat utilizing appliances 102 can be readily set in place over exhaust outlet 112 and lifted therefrom. However, at least one modular heat utilizing appliance 102 may include a stabilizer opposing dislodging of modular heat utilizing appliance 102 from a seating above second exhaust outlet 112. The stabilizer may comprise downwardly facing projections 148 or a continuous downwardly facing short wall 150. Projections 148 and short wall 150 oppose lateral movement of their respective modular heat utilizing appliances 102, and thereby provide lateral stability. It would also be possible to provide stabilizers that oppose upward movement of a modular heat utilizing appliance 102, such as a latch or a through bolt placed through aligned holes in burner 100 and an installed modular heat utilizing appliance 102 (the latter types of stabilizers are not shown).

At least one modular heat utilizing appliance 102 may comprise thermal insulation 152 retaining heat therein. Thermal insulation 152 may comprise mineral wool or fibers, expanded minerals such as vermiculite, hollow glass spheres, a ceramic coating, or may take other forms. Thermal insulation 152 may comprise either or both of natural and synthetic materials, and may comprise one type of material or any combination of thermally insulating materials.

The present invention is susceptible to modifications and variations which may be introduced thereto without departing from the inventive concepts. More specifically, the invention contemplates that any optional feature may be provided with or without any other optional feature, as these are not mutually exclusive.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A burner for a heat utilizing appliance, the burner comprising:

a fire box and a fuel holder within the fire box, wherein the fire box comprises a wall surrounding and located above the fuel holder and a top opening including an open top end;

an inner housing spaced apart from and surrounding the fire box, the inner housing comprising a first lateral wall, a tapered top wall, and a first exhaust outlet;

an ash pan coupled to the burner below the fuel holder so that the ash pan is movable between a closed position closing a bottom of the inner housing of the burner and an open position enabling removal of ashes from the ash pan;

an outer shroud surrounding and spaced apart from an upper portion of the inner housing of the burner, the outer shroud comprising a second lateral wall, that spans a length from the top of the burner to a position above the ash pan, and a second exhaust outlet, the outer shroud configured to constrain air immediately outside the inner housing to flow by convection radially inwardly to join exhaust products flowing upwardly from the first exhaust outlet, thereby interposing a thermally insulating barrier between the inner housing and an exterior of the burner;

at least one air opening in the inner housing admitting air to assist combustion, wherein at least one air opening includes a flow adjuster adjustable to selectively vary flow of air through the air opening including the flow adjuster; and a fuel chute coupled to the burner and passing through the outer shroud and the inner housing thereby being arranged to communicate between an interior of the fire box and ambient air outside the burner and accessible for receiving and conducting solid fuel into the fire box without requiring moving of a heat utilizing appliance sitting on the second exhaust outlet, wherein the first lateral wall and the tapered top wall of the inner housing, and the second lateral wall and a top wall portion of the outer shroud are collectively configured to guide inducted air flowing around the fuel holder inwardly from a periphery of the fire box to join exhaust products flowing upwardly through the second exhaust outlet when solid fuel is being burned in the fuel holder, thereby supporting secondary combustion above the fuel holder.

2. The burner of claim 1, further comprising a plurality of legs coupled to the burner and spacing the burner above the ground.

3. The burner of claim 1, wherein the at least one air opening includes at least one first air opening below the fire box and the fuel holder.

4. The burner of clam 1, wherein the at least one air opening includes at least one second air opening above the fire box and the fuel holder.

5. The burner of claim 1, wherein the at least one air opening includes at least one third air opening having a powered fan arranged to force air induction to the fuel holder.

6. The burner of claim 1, wherein the fuel chute includes a slidable closure slidable between an open position providing access to the burner for charging the fire box with solid fuel and a closed position preventing products of combustion from escaping the burner through the fuel chute.

7. The burner of claim 6, wherein the fuel chute engages the slidable closure with sufficient friction to oppose spontaneous opening of the slidable closure under ordinary conditions of use.

8. A combination of a burner and a modular heat utilizing appliance, the combination comprising:

a burner for a heat utilizing appliance, the burner comprising:

a fire box and a fuel holder within the fire box, wherein the fire box comprises a wall surrounding and located above the fuel holder and a top opening including an open top end;

an inner housing spaced apart from and surrounding the fire box, the inner housing comprising a first lateral wall, a tapered top wall, and a first exhaust outlet;

an ash pan coupled to the burner below the fuel holder so that the ash pan is movable between a closed position closing a bottom of the fire box of the burner and an open position enabling removal of ashes from the ash pan;

an outer shroud surrounding and spaced apart from an upper portion of the inner housing of the burner, the outer shroud comprising a second lateral wall, that spans a length from the top of the burner to a position above the ash pan, and a second exhaust outlet, the outer shroud configured to constrain air immediately outside the inner housing to flow by convection radially inwardly to join exhaust products flowing upwardly from the first exhaust outlet, thereby interposing a thermally insulating barrier between the inner housing and an exterior of the burner; and at least one air opening in the inner housing admitting air to assist combustion, wherein at least one air opening includes a flow adjuster adjustable to selectively vary flow of air through the air opening including the flow adjuster, wherein the first lateral wall and the tapered top wall of the inner housing, and the second lateral wall a top wall portion of the outer shroud are collectively configured to guide inducted air flowing around the fuel holder inwardly from a periphery of the fire box to join exhaust products flowing upwardly through the second exhaust outlet when solid fuel is being burned in the fuel holder, thereby supporting secondary combustion above the fuel holder; and at least one modular heat utilizing appliance having a lower surface dimensioned and configured to rest on the top end above the second exhaust outlet, whereby the modular heat utilizing appliance can exploit heat in the exhaust products flowing upwardly through the second exhaust outlet.

9. The combination of claim 8, wherein the at least one modular heat utilizing appliance includes a stabilizer opposing dislodging of the modular heat utilizing appliance from a seating above the second exhaust outlet.

10. The combination of claim 8, wherein at least one modular heat utilizing appliance comprises thermal insulation retaining heat therein.

* * * * *